US008675020B2

(12) United States Patent
Lim

(10) Patent No.: US 8,675,020 B2
(45) Date of Patent: Mar. 18, 2014

(54) IMAGE DISPLAY DEVICES AND METHODS OF DISPLAYING IMAGE

(75) Inventor: Euicheol Lim, Hwaseong-si (KR)

(73) Assignee: Samsung Electronics Co., Ltd. (KR)

( * ) Notice: Subject to any disclaimer, the term of this patent is extended or adjusted under 35 U.S.C. 154(b) by 406 days.

(21) Appl. No.: 13/076,654

(22) Filed: Mar. 31, 2011

(65) Prior Publication Data

US 2011/0242131 A1 Oct. 6, 2011

(30) Foreign Application Priority Data

Apr. 1, 2010 (KR) ..... 10-2010-0029746

(51) Int. Cl.
*G09G 5/00* (2006.01)
*G09G 5/02* (2006.01)

(52) U.S. Cl.
USPC ..... 345/634; 345/592

(58) Field of Classification Search
USPC ..... 345/620–641, 589, 592
See application file for complete search history.

(56) References Cited

U.S. PATENT DOCUMENTS

| | | | | |
|---|---|---|---|---|
| 4,692,757 | A * | 9/1987 | Tsuhara et al. | 345/636 |
| 5,587,723 | A * | 12/1996 | Otake et al. | 345/626 |
| 6,522,341 | B1 * | 2/2003 | Nagata | 345/639 |
| 6,628,297 | B1 * | 9/2003 | Wraae et al. | 345/628 |
| 6,661,425 | B1 * | 12/2003 | Hiroaki | 345/629 |
| 6,710,777 | B1 * | 3/2004 | Chun et al. | 345/545 |
| 6,924,807 | B2 * | 8/2005 | Ebihara et al. | 345/503 |
| 6,999,103 | B2 * | 2/2006 | Matsumoto et al. | 345/620 |
| 7,139,970 | B2 * | 11/2006 | Michaud et al. | 715/247 |
| 7,171,057 | B1 * | 1/2007 | Wilensky et al. | 382/284 |
| 7,483,042 | B1 * | 1/2009 | Glen | 345/629 |
| 7,554,563 | B2 * | 6/2009 | Jeong | 345/636 |
| 7,840,090 | B2 * | 11/2010 | Asai | 382/276 |
| 7,949,943 | B2 * | 5/2011 | Michaud et al. | 715/234 |
| 7,965,293 | B2 * | 6/2011 | Fujiwara et al. | 345/467 |
| 7,978,196 | B2 * | 7/2011 | Combes et al. | 345/441 |
| 8,090,299 | B2 * | 1/2012 | Mori et al. | 399/237 |
| 8,184,127 | B2 * | 5/2012 | Jeong | 345/619 |
| 8,212,842 | B2 * | 7/2012 | Shiomi et al. | 345/629 |
| 8,339,653 | B2 * | 12/2012 | Nguyen et al. | 358/1.18 |
| 8,446,432 | B2 * | 5/2013 | Adhikari et al. | 345/636 |
| 2005/0213853 | A1 * | 9/2005 | Maier et al. | 382/302 |
| 2011/0057952 | A1 * | 3/2011 | Lee | 345/634 |

FOREIGN PATENT DOCUMENTS

| | | | |
|---|---|---|---|
| JP | 2008-067133 | | 3/2008 |
| KR | 100281509 | B1 | 11/2000 |
| KR | 1020070024282 | A | 3/2007 |
| KR | 1020090040454 | A | 4/2009 |

* cited by examiner

*Primary Examiner* — Ryan R Yang
(74) *Attorney, Agent, or Firm* — Myers Bigel Sibley & Sajovec, P.A.

(57) ABSTRACT

Provided are an image display method and an image display device. The method includes: reading first layer data; reading partial data of second layer data; and blending the read first layer data and the read partial data of the second layer data and displaying the blended data. The image display device includes: a processing unit generating first and second layer data and storing the generated first and second layer data in a storage unit; and a display unit reading the first layer data and partial data of the second layer data from the storage unit, blending the read first layer data and the read partial data of the second layer data, and displaying the blended data.

15 Claims, 10 Drawing Sheets

Fig. 8

155

| | C1 | C2 | C3 | C4 | C5 | C6 | C7 | C8 | C9 | C10 | C11 | C12 | C13 | C14 | C15 | C16 |
|---|---|---|---|---|---|---|---|---|---|---|---|---|---|---|---|---|
| R1 | 1 | 1 | 1 | 1 | 1 | 1 | 1 | 1 | 1 | 1 | 1 | 1 | 1 | 1 | 1 | 1 |
| R2 | 1 | 1 | 1 | 1 | 1 | 1 | 1 | 1 | 1 | 1 | 1 | 1 | 1 | 1 | 1 | 1 |
| R3 | 0 | 0 | 0 | 0 | 0 | 0 | 0 | 0 | 0 | 0 | 0 | 0 | 1 | 1 | 1 | 1 |
| R4 | 0 | 0 | 0 | 0 | 0 | 0 | 0 | 0 | 0 | 0 | 0 | 0 | 1 | 1 | 1 | 1 |
| R5 | 0 | 0 | 0 | 0 | 0 | 0 | 0 | 0 | 0 | 0 | 0 | 0 | 1 | 1 | 1 | 1 |
| R6 | 0 | 0 | 0 | 0 | 0 | 0 | 0 | 0 | 0 | 0 | 0 | 0 | 1 | 1 | 1 | 1 |
| R7 | 0 | 0 | 0 | 0 | 1 | 1 | 1 | 1 | 1 | 0 | 0 | 0 | 1 | 1 | 1 | 1 |
| R8 | 0 | 0 | 0 | 0 | 1 | 1 | 1 | 1 | 1 | 0 | 0 | 0 | 1 | 1 | 1 | 1 |
| R9 | 0 | 0 | 0 | 0 | 1 | 1 | 1 | 1 | 1 | 0 | 0 | 0 | 1 | 1 | 1 | 1 |
| R10 | 0 | 0 | 0 | 0 | 0 | 0 | 0 | 0 | 0 | 0 | 0 | 0 | 1 | 1 | 1 | 1 |
| R11 | 0 | 0 | 0 | 0 | 0 | 0 | 0 | 0 | 0 | 0 | 0 | 0 | 1 | 1 | 1 | 1 |
| R12 | 0 | 0 | 0 | 0 | 0 | 0 | 0 | 0 | 0 | 0 | 0 | 0 | 1 | 1 | 1 | 1 |
| R13 | 1 | 1 | 1 | 1 | 0 | 0 | 1 | 1 | 1 | 1 | 0 | 0 | 1 | 1 | 1 | 1 |
| R14 | 1 | 1 | 1 | 1 | 0 | 0 | 1 | 1 | 1 | 1 | 0 | 0 | 1 | 1 | 1 | 1 |

IMAGE DISPLAY DEVICES AND METHODS OF DISPLAYING IMAGE

CROSS-REFERENCE TO RELATED APPLICATIONS

This U.S. non-provisional patent application claims priority under 35 U.S.C. §119 of Korean Patent Application No. 10-2010-0029746, filed on Apr. 1, 2010, the entire contents of which are hereby incorporated by reference.

BACKGROUND

The present disclosure herein relates to image display devices and methods of displaying an image.

An image display device is one type of user interfaces that may provide information to a user. Since the image display device provides an interface based on vision, power of delivering information is excellent.

Different types of image display devices have been developed as technology has advanced. For example, image display devices have been provided in a variety of forms, such as a cathode ray tube (CRT) display device, a liquid crystal display (LCD) device, a thin film transistor (TFT) LCD device, a plasma display panel (PDP) device, an organic light emitting diode (OLED) display device, and an active matrix OLED (AMOLED) display device.

Moreover, in order to transmit diverse information through the image display device, techniques for blending a plurality of data layers into one frame has been studied.

SUMMARY

The present disclosure provides an image display device and a method of displaying an image with improved operating efficiency and reduced power consumption.

Embodiments of the inventive concept provide image display methods including reading first layer data, reading partial data of second layer data, blending the first layer data and the partial data of the second layer data to generate blended data, and displaying the blended data.

Some embodiments provide that the second layer data includes valid data and invalid data and that reading the partial data of the second layer data includes reading the valid data of the second layer data. Some embodiments include updating the second layer data and when the second layer data are updated, reading the first layer data and the updated second layer data, blending the first layer data and the read second layer data to generate the blended data. Some embodiments provide that, after updating the second layer data, valid data in the updated second layer data is detected.

Some embodiments provide that after detecting the valid data in the updated second layer data, reading the first layer data, reading valid data in the updated second layer data, blending the read first layer data and the read valid data of the second layer data, and displaying the blended data. In some embodiments, detecting the valid data includes dividing the second layer data into multiple data blocks and detecting data of at least one of the data blocks that includes a valid pixel value as valid data. Some embodiments provide that an invalid pixel value corresponds to a specific chroma-key value, whereas some embodiments provide that the invalid pixel value corresponds to a specific alpha value.

In some embodiments, reading the first layer data includes reading partial data of the first layer data. Some embodiments include reading partial data of third layer data and blending the first layer data, the partial data of the second layer data and the partial data of third layer data to generate the blended data.

Some embodiments of the present invention include an image display device that includes a processing unit that is configured to generate first layer data and second layer data and to store the generated first layer data and the generated second layer data in a storage unit. A display unit is configured to read the first layer data and partial data of the second layer data from the storage unit, to blend the read first layer data and the partial data of the second layer data to generate blended data, and to display the blended data.

In some embodiments, the display unit includes a display buffer that is configured to store information about valid data and invalid data in the second layer data and to read the valid data in the second layer data from the storage unit based on the information stored in the display buffer without reading the invalid data in the second layer data.

Some embodiments provide that the second layer data is divided into multiple data blocks that correspond to multiple bits of the display buffer, respectively. Some embodiments provide that according to whether a specific one of the data blocks includes a valid pixel value or not, a corresponding one of the bits of the display buffer is set as a first logic value or a second logic value.

In some embodiments, the display unit is configured to read data of at least one of the data blocks of the second layer data corresponding to bits having the first logic value among the bits of the display buffer. Some embodiments provide that when the second layer data are updated, the processing unit is configured to activate a reset signal and the display unit is configured to reset the bits of the display buffer as the first logic value in response to the activated reset signal.

In some embodiments, the processing unit is further configured to store third layer data in the storage unit and the display unit is further configured to read the first layer data, the partial data of the second layer data, and partial data of the third layer data from the storage unit, to blend the read first layer data, the read partial data of the second layer data, and the read partial data of the third layer data, and to display the blended data.

Some embodiments provide that the display unit includes a first display buffer that is configured to store information about valid data and invalid data in the second layer data and a second display buffer that is configured to store information about valid data and invalid data in the third layer data. In some embodiments, the display unit is configured to read valid data in the second layer data from the storage unit based on the information stored in the first display buffer and to read valid data in the third layer data from the storage unit based on the information stored in the second display buffer. Some embodiments provide that the first and second buffers respectively correspond to first and second storage regions in one buffer.

Some embodiments of the present invention include methods of displaying image data. Such methods may include reading first layer data and second layer data from an image display device data storage unit, detecting invalid data in the second layer data, storing, and in a display buffer, information corresponding to the invalid data in the second layer data. Some embodiments provide that the second layer data is adjusted responsive to the invalid data. A display frame is generated by blending the first layer data and adjusted second layer data and is displayed.

In some embodiments, the second layer data includes valid data and the invalid data and reading the data of the second layer data includes reading the valid data of the second layer data.

It is noted that aspects of the invention described with respect to one embodiment, may be incorporated in a different embodiment although not specifically described relative thereto. That is, all embodiments and/or features of any embodiment can be combined in any way and/or combination. These and other objects and/or aspects of the present invention are explained in detail in the specification set forth below.

BRIEF DESCRIPTION OF THE DRAWINGS

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings:

FIG. 8 is a view illustrating a state of the display buffer 155 according to some embodiments of the operations of FIG. 7;

DETAILED DESCRIPTION OF THE EMBODIMENTS

Figure 1:
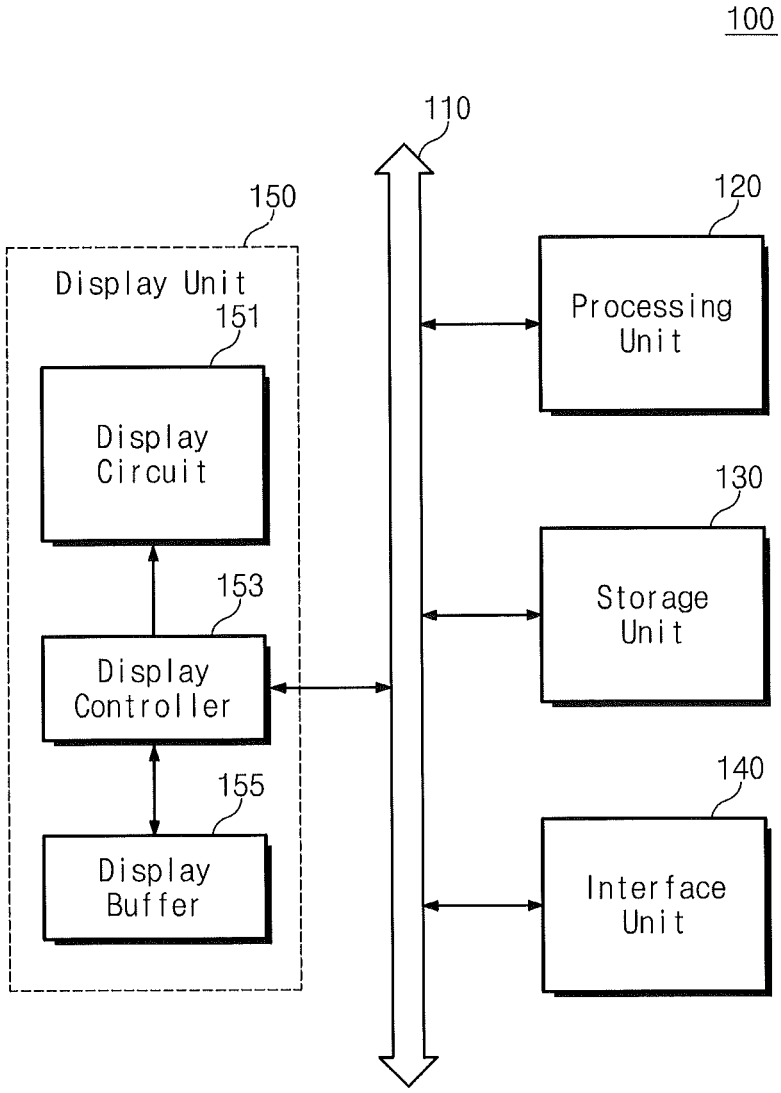
FIG. 1 is a block diagram illustrating an image display device 100 according to some embodiments of the inventive concept.

The present invention now will be described more fully hereinafter with reference to the accompanying drawings, in which embodiments of the invention are shown. However, this invention should not be construed as limited to the embodiments set forth herein. Rather, these embodiments are provided so that this disclosure will be thorough and complete, and will fully convey the scope of the invention to those skilled in the art.

It will be understood that, although the terms first, second, etc. may be used herein to describe various elements, these elements should not be limited by these terms. These terms are only used to distinguish one element from another element. Thus, a first element discussed below could be termed a second element without departing from the scope of the present invention. In addition, as used herein, the singular forms "a", "an" and "the" are intended to include the plural forms as well, unless the context clearly indicates otherwise. It also will be understood that, as used herein, the term "comprising" or "comprises" is open-ended, and includes one or more stated elements, steps and/or functions without precluding one or more unstated elements, steps and/or functions. The term "and/or" includes any and all combinations of one or more of the associated listed items.

It will also be understood that when an element is referred to as being "connected" to another element, it can be directly connected to the other element or intervening elements may be present. In contrast, when an element is referred to as being "directly connected" to another element, there are no intervening elements present. It will also be understood that the sizes and relative orientations of the illustrated elements are not shown to scale, and in some instances they have been exaggerated for purposes of explanation.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein. The present invention will now be described more fully hereinafter with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will fully convey the scope of the invention to those skilled in the art.

It should be construed that forgoing general illustrations and following detailed descriptions are exemplified and an additional explanation of claimed inventions is provided.

Reference numerals are indicated in detail in some embodiments of the present invention, and their examples are represented in reference drawings. Throughout the drawings, like reference numerals are used for referring to the same or similar elements in the description and drawings.

FIG. 1 is a block diagram illustrating an image display device 100 according to some embodiments of the inventive concept. Referring to FIG. 1, the image display device 100 includes a system bus 110, a processing unit 120, a storage unit 130, an interface unit 140, and a display unit 150.

The system bus 110 is configured to provide a channel between components of the image display device 100.

The processing unit 120 is configured to control general operations of the image display device 100. For example, the processing unit 120 is configured to store data of layers constituting a frame in the storage unit 130. For example, the processing unit 120 may be a general processor and/or an image processing processor.

The storage unit 130 may operate as an operating memory, a cache memory, and/or a buffer memory of the image display device 100.

For example, the storage unit 130 may be a volatile memory such as a random access memory (RAM), a dynamic RAM (DRAM), and/or a synchronous DRAM (SDRAM). The storage unit 130 may be a nonvolatile memory such as an electrically erasable and programmable read only memory (EEPROM), a flash memory, a phase change RAM (PRAM), a magnetic RAM (MRAM), a resistive RAM (RRAM), and/or a ferroelectric RAM (FeRAM).

For example, the storage unit 130 may be a hard disk drive (HDD) or a solid state drive (SSD).

The interface unit 140 is configured to interface with devices, people, and/or systems that are external to the image display device 100. For example, the interface unit 140 may include a user interface for interfacing with a user. In some embodiments, the interface unit 140 may include an interface for communicating with another electronic device. The interface unit 140 may communicate with other electronic devices through wireless and/or wired communication.

The display unit 150 is configured to read data of layers stored in the storage unit 130. The display unit 150 is configured to generate a frame by blending the data of read layers. The display unit 150 is configured to display the generated frame.

The display unit 150 includes a display circuit 151, a display controller 153, and a display buffer 155.

The display circuit 151 is configured to display the frame. For example, the display circuit 151 may include a circuit such as a cathode ray tube (CRT) circuit, a liquid crystal display (LCD) circuit, a thin film transistor (TFT) LCD circuit, a plasma display panel (PDP) circuit, an organic light emitting diode (OLED) circuit, an active matrix OLED (AMOLED) circuit, and/or a projector.

The display controller 153 is configured to control general operations of the display unit 150. For example, the display controller 153 is configured to read data of layers from the storage unit 130. The display controller 153 generates a frame by blending the data of read layers. The generated frame is displayed through the display circuit 151.

For example, the display controller 153 may be configured to store information about data of a specific layer read from the storage unit 130 in the display buffer 155. Based on the information stored in the display buffer 155, the display unit 153 is configured to read partial data among the data of the specific layer from the storage unit 130. The display unit 153 may generate a frame by blending the partial data of the read specific layer and data of another layer.

For example, the image display device 100 may be provided as one of various components of an electronic device such as a computer, a ultra mobile personal computer (UMPC), a workstation, a net-book, a personal digital assistance (PDA), a portable computer (PC), a web tablet, a wireless phone, a mobile phone, a smart phone, an e-book, a portable multimedia player (PMP), a portable game console, a navigation, a black box, a digital camera, a digital multimedia broadcasting (DMB) player, a digital audio recorder, a digital audio player, a digital picture recorder, a digital picture player, a digital video recorder, a digital video player, a device for transmitting and receiving information through a wireless environment, one of various electronic devices constituting a home network, one of various electronic devices constituting a computer network, one of various electronic devices constituting a telematics network, a radio frequency identification (RFID) device, and/or one of various components constituting a computing system.

Figure 2:
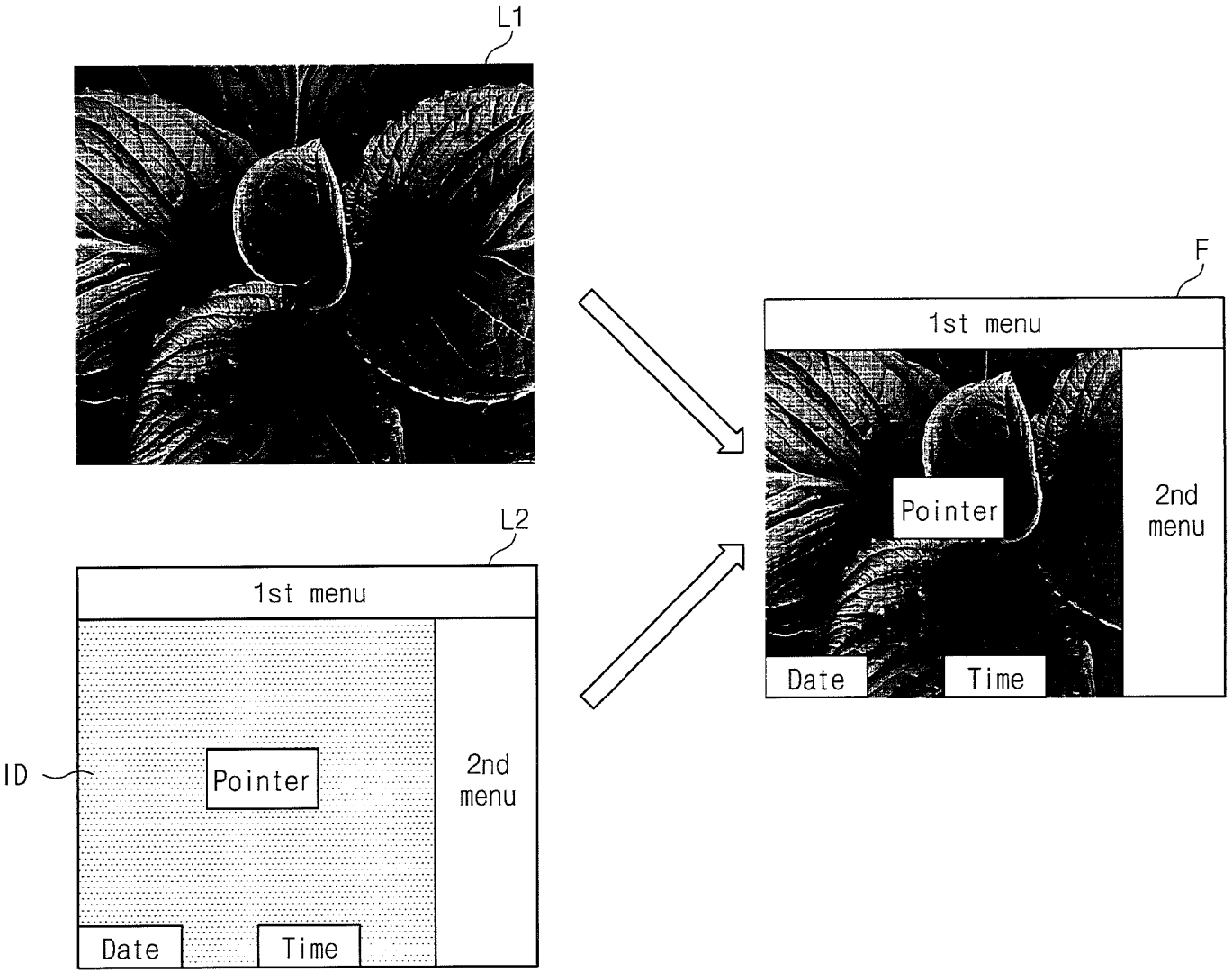
FIG. 2 is a view illustrating a process of generating a frame by blending data of layers according to the image display device 100 of FIG. 1.

FIG. 2 is a view illustrating a process of generating a frame by blending data of layers according to the image display device 100 of FIG. 1. As an example, a first layer data L1 and a second layer data L2 are blended to generate a frame F. However, the frame F is not limited to being generated by blending the data L1 and L2 of two layers. For example, the frame F may be generated by blending data of three or more different layers.

For example, the first layer data L1, the second layer data L2, and the frame F may include values of pixels having a predetermined resolution. Each pixel value is presented with a value based on at least one of different standards such as RGB, HSU, and YIQ. In FIG. 2, for convenience of description, the first layer data L1, the second layer data L2, and the frame F are illustrated in a form of an image.

Referring to FIGS. 1 and 2, the first layer data L1 corresponds to a background image. The second layer data L2 corresponds to a menu image. The second layer data L2 includes data corresponding to a first menu (hereinafter, referred to as first menu data), data corresponding to a second menu (hereinafter, referred to as second menu data), data corresponding to a pointer (hereinafter, referred to as pointer data), data corresponding to a date (hereinafter, referred to as date data), and data corresponding to a time (hereinafter, referred to as time data). However, the second layer data L2 is not limited to including the first menu data, the second menu data, the pointer data, the date data, and the time data.

The second layer data L2 is divided into valid data and invalid data ID. The valid data are displayed in the frame F and the invalid data ID are not displayed in the frame F. For example, the first menu data, the second menu data, the pointer data, the date data, and the time data in the second layer data L2 are displayed in the frame F. Accordingly, the first menu data, the second menu data, the pointer data, the date data, and the time data are valid data and other data ID are invalid data. For example, the invalid data ID are indicated with dots in the second layer data L2.

Some embodiments provide that pixel values corresponding to the invalid data ID correspond to specific chroma-key values. For example, the pixel values corresponding to the invalid data ID may be chroma-key values corresponding to blue or green. The display controller 153 removes the invalid data ID corresponding to a specific chroma-key value from the second layer data L2. For example, the display controller 153 removes the invalid data ID corresponding to a chroma-key value of blue or green from the second layer data L2.

For example, pixel values corresponding to the invalid data ID may correspond to specific alpha values. The alpha values may correspond to transparency. For example, the alpha value corresponding to the invalid data ID may be the minimum value or the maximum value. The display controller 153 controls the transparency of the second layer L2 based on the alpha value set in the second layer data L2. For example, based on the alpha value set in the second layer data L2, the display controller 153 processes the invalid data ID to be transparently displayed.

The display controller 153 generates a frame F by blending the first layer data L1 and the adjusted second layer data L2. As mentioned above, the invalid data ID of the second layer data L2 are removed or adjusted to be transparently displayed. Accordingly, in the generated frame F, the first menu, the second menu, the pointer, the date, and the time corresponding to the second layer data L2 are displayed on a background image corresponding to the first layer data L1.

As mentioned above, the valid data in the second layer data L2 include data displayed as the frame F and the invalid data ID include a specific chroma-key value or a specific alpha value. In addition, the invalid data ID are not displayed as the frame F. Accordingly, when the second layer data L2 are read from the storage unit 130, an operation for reading the invalid data ID with a specific chroma-key value or alpha value may be regarded as wasting a bandwidth of the storage unit 130.

As an image display technique is developed, an image display frequency is increased. For example, an image display frequency is increased to about 60 Hz, about 120 Hz, and about 240 Hz. If the image display frequency is about 60 Hz, the display unit 150 is configured to read the first layer data L1 and the second layer data L2 stored in the storage unit 150 by 60 times per sec and display them. If the image display frequency is about 240 Hz, the display unit 150 is configured to read the first layer data L1 and the second layer data L2 stored in the storage unit 150 by 240 times per sec and display them. That is, as the image display frequency is increased, wasting of a bandwidth caused from reading of the invalid data ID from the storage unit 130 is increased.

In order to resolve the above limitation, the image display device 100 according to some embodiments of the inventive concept is configured to generate a frame F by reading partial data (for example, valid data) from the second layer data L2.

Figure 3:
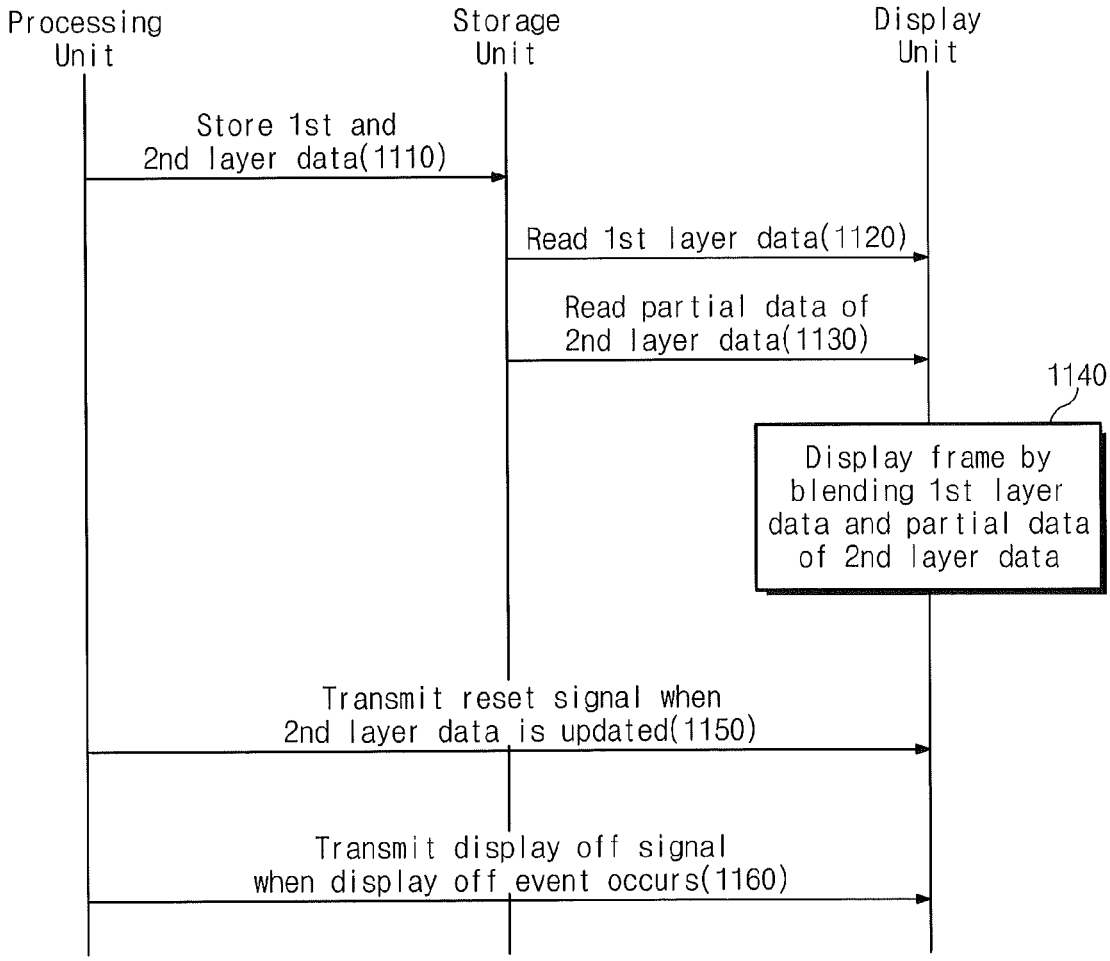
FIG. 3 is a flowchart illustrating operations according to some embodiments of methods corresponding to the image display device 100 of FIG. 1.

FIG. 3 is a flowchart illustrating an operating method of the image display device 100 of FIG. 1. Referring to FIGS. 1 through 3, in operation 1110, the processing unit 120 stores the first layer data L1 and the second layer data L2 in the storage unit 130.

In operation 1120, the display unit 150 reads the first layer data L1 stored in the storage unit 130. In operation 1130, the display unit 150 reads partial data among the second layer data L2 stored in the storage unit 130. For example, the display unit 150 may read valid data from the second layer data L2. For example, the display unit 150 reads valid data from the second layer data L2 based on the information stored in the display buffer 155. A configuration method of the display buffer 155 will be described in more detail with reference to FIG. 4.

In operation 1140, the display unit 150 displays a frame by blending the first layer data L1 read from the storage unit 130 and the partial data of the second layer data L2. That is, partial data are read from the second layer data L2 and a frame is generated based on the read partial data. Since only the partial data are read from the second layer data L2, a bandwidth of the storage unit 130 that the display unit 150 consumes can be reduced. That is, bandwidth efficiency of the storage unit 130 can be improved thereby reducing power consumption.

In operation 1150, when the second layer data L2 are updated, the processing unit 120 may transmit a reset signal to the display unit 150. Operation 1150 is not limited to being performed after operation 1140. For example, some embodiments provide that operation 1150 is performed when the second layer data L2 are updated.

In operation 1160, when a display off event occurs, the processing unit 120 transmits a display off signal to the display unit 150. For example, when the image display device 100 enters a sleep mode, the processing unit 120 may transmit the display off signal to the display unit 150. Operation 1160 is not limited to being performed after operation 1140 or 1150. For example, some embodiments provide that operation 1160 is performed when the display off event occurs.

Figure 4:
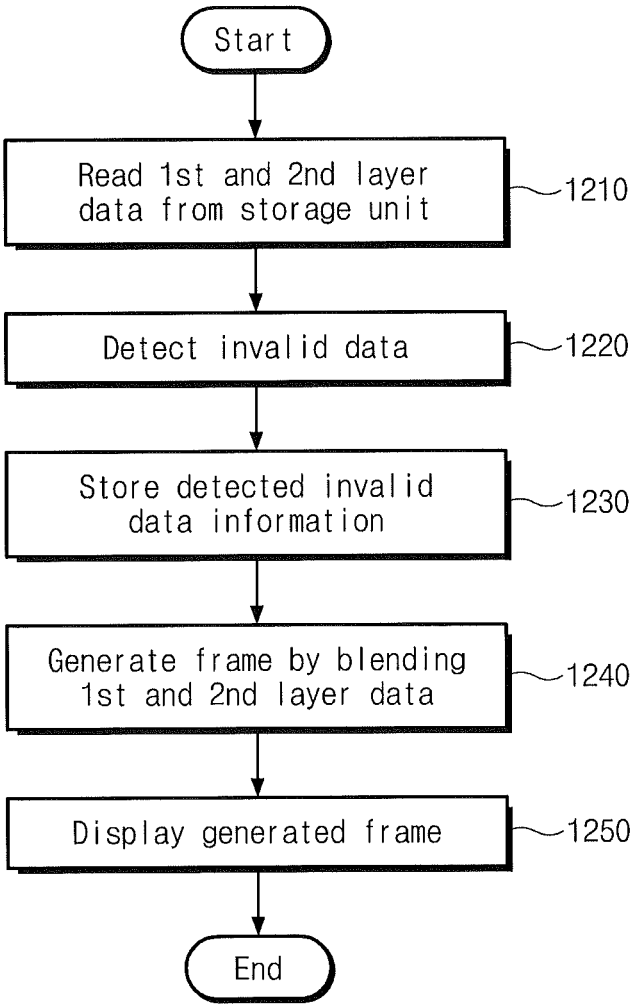
FIG. 4 is a flowchart illustrating operations according to some embodiments of methods of configuring the display buffer 155 in the display unit 150 of FIG. 1.

FIG. 4 is a flowchart illustrating a method of configuring the display buffer 155 in the display unit 150 of FIG. 1. Referring to FIGS. 1, 2, and 4, in operation 1210, the display unit 150 reads the first layer data L1 and the second layer data L2 from the storage unit 130. For example, the display controller 153 of the display unit 150 reads the first layer data L1 and the second layer data L2.

In operation 1220, invalid data ID are detected. For example, the display controller 153 detects the invalid data ID from the second layer data L2. In some embodiments, the display controller 153 detects data corresponding to a specific chroma-key value from the second layer data L2, as the invalid data ID.

In operation 1230, information of the detected invalid data ID is stored. For example, the display controller 153 stores the information of the detected invalid data ID in the display buffer 155.

In operation 1240, the first layer data L1 and the second layer data L2 are blended to generate a frame F. For example, the display controller 153 generates the frame F by blending the read first and second layer data L1 and L2. For example, the display controller 153 adjusts the second layer data L2 based on a chroma-key value or an alpha value. Then, the read first layer data L1 and the adjusted second layer data L2 are blended to generate the frame F. Then, in operation 1250, the generated frame F is displayed. For example, the display controller 153 controls the display circuit 151 to display the generated frame F.

As mentioned above, the display unit 150 reads the second layer data L2, detects the invalid data ID from the second layer data L2, and stores information about the detected invalid data ID in the display buffer 155. That is, when the second layer data L2 are received (for example, when the entire second layer data L2 are received), the display unit 150 may recognize information of the invalid data ID among the second layer data L2.

As mentioned above, the second layer data L2 includes the valid data and the invalid data ID. Accordingly, detecting the invalid data ID in operation 1220 may be regarded as an operation for detecting valid data. Moreover, storing the information about the detected invalid data ID in operation 1230 may be regarded as an operation for storing information about the detected valid data.

Figure 5:
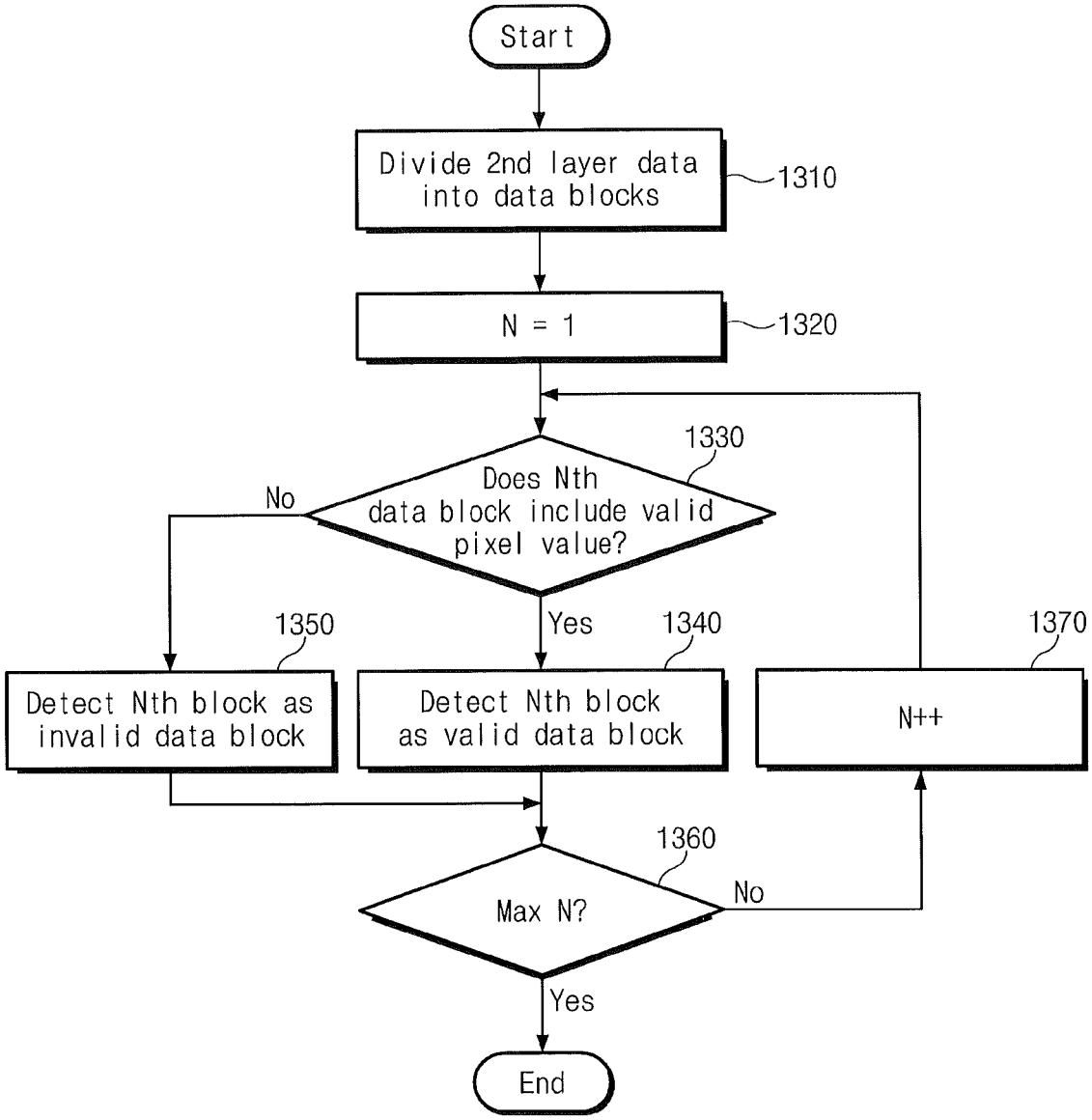
FIG. 5 is a flowchart illustrating operations according to some embodiments of methods of detecting the invalid data ID in operations described in block 220 of FIG. 4.
Figure 6:
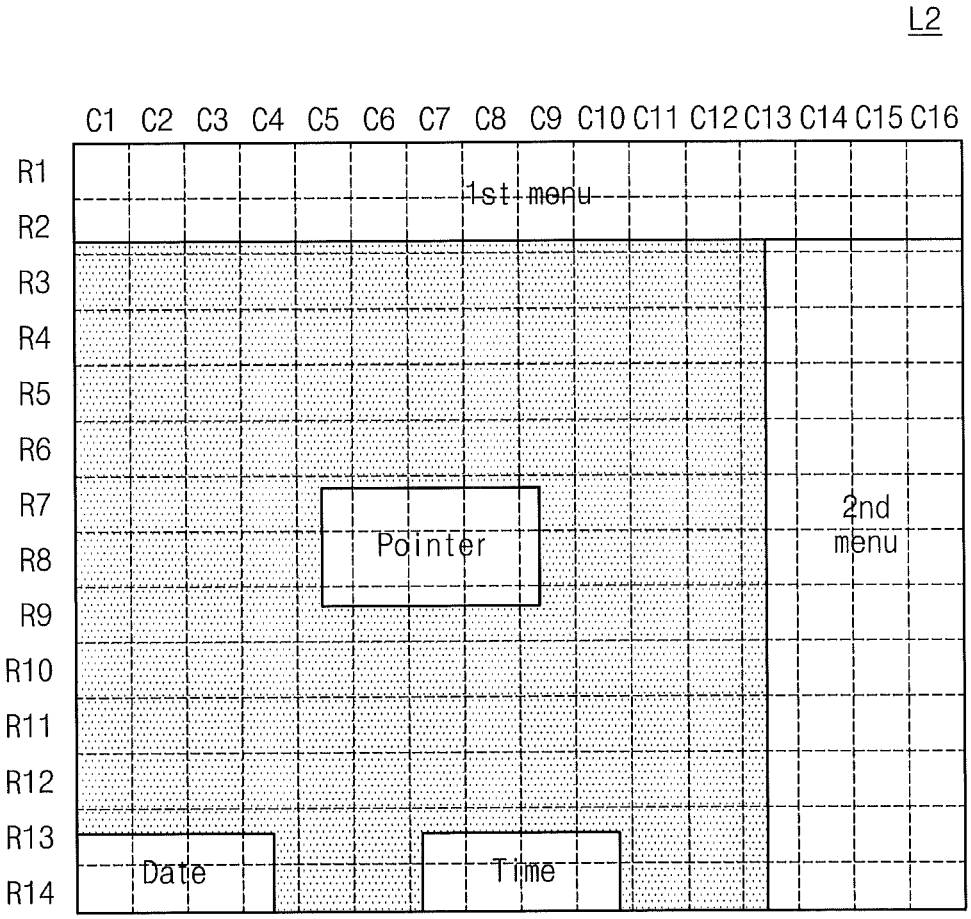
FIG. 6 is a view illustrating the second layer data L2 according to the detection methods of FIG. 4.

FIG. 5 is a flowchart illustrating a method of detecting the invalid data ID in operation 1220 of FIG. 4. FIG. 6 is a view illustrating the second layer data L2 according to the detection method of FIG. 4.

Referring to FIGS. 1, 5, and 6, in operation 1310, the second layer data L2 are divided into data blocks. For example, as shown in FIG. 6, the second layer data L2 may be divided into data blocks corresponding to first to fourteenth rows R1 to R14 and first to sixteenth columns C1 to C16. However, the second layer data L2 is not limited to the divided data blocks of FIG. 6. In operation 1320, a block variable N is set as 1.

In operation 1330, it is determined whether the Nth data block includes a valid pixel value. That is, it is determined whether the Nth data block includes an invalid pixel value. For example, the invalid pixel value is a specific chroma-key value or a specific alpha value.

If the Nth data block includes a valid pixel value, in operation 1340, the Nth data block is determined as a valid data block. If the Nth data block does not include a valid pixel value, that is, when the N data includes an invalid pixel value, in operation 1350, the Nth data block is determined as an invalid data block.

In operation 1360, it is determined whether a value of the block variable N is the maximum value or not. That is, it is determined whether each of the data blocks includes valid data or invalid data in operations 1330 to 1350. If all data blocks are determined as the valid data block or invalid data block, the detection operation of the invalid data ID is terminated. If there are data blocks that are not determined yet as a valid data block or an invalid data block, the block variable N is added by a predetermined value in operation 1370. Then, operation 1330 is performed again.

As shown in FIG. 6, data blocks of the first and second rows R1 and R2 include valid pixel values corresponding to first menu data. Accordingly, the data blocks of the first and second rows R1 and R2 are determined as valid data blocks.

Data blocks of the thirteenth to sixteenth columns C13 to C16 include valid pixel values corresponding to the first menu data and the second menu data. Accordingly, the data blocks of the thirteenth to sixteenth columns C13 to C16 are determined as valid data blocks.

Data blocks of the seventh row and fifth column R7 and C5 to the ninth row and ninth column R9 and C9 include valid pixel values corresponding to pointer data. Accordingly, the data blocks of the seventh row and fifth column R7 and C5 to the ninth row and ninth column R9 and C9 are determined as valid data blocks.

Data blocks of the thirteenth row and first column R13 and C1 to the fourteenth row and fourth column R14 and C4 include valid pixel values corresponding to date data. Accordingly, the data blocks of the thirteenth row and first column R13 and C1 to the fourteenth row and fourth column R14 and C4 are determined as valid data blocks.

Data blocks of the thirteenth row and seventh column R13 and C7 to the fourteenth row and tenth column R14 and C10 include valid pixel values corresponding to time data. Accordingly, the data blocks of the thirteenth row and seventh column R13 and C7 to the fourteenth row and tenth column R14 and C10 are determined as valid data blocks.

The data blocks of the third row and first column R3 and C1 to the sixth row and twelfth column R6 and C12, the data blocks of the seventh row and first column R7 and C1 to the ninth row and fourth column R9 and C4, the data blocks of the seventh row and tenth column R7 and C10 to the ninth row and twelfth column R9 and C12, the data blocks of the tenth row and first column R10 and C1 to the twelfth row and twelfth column R12 and C12, the data blocks of the thirteenth row and fifth column R13 and C5 to the fourteenth row and sixth column R14 and C6, and the data blocks of the thirteenth row and eleventh column R13 and C11 to the fourteenth row and twelfth column R14 and C12 do not have valid pixel values, and thus are determined as invalid data blocks.

Figure 7:
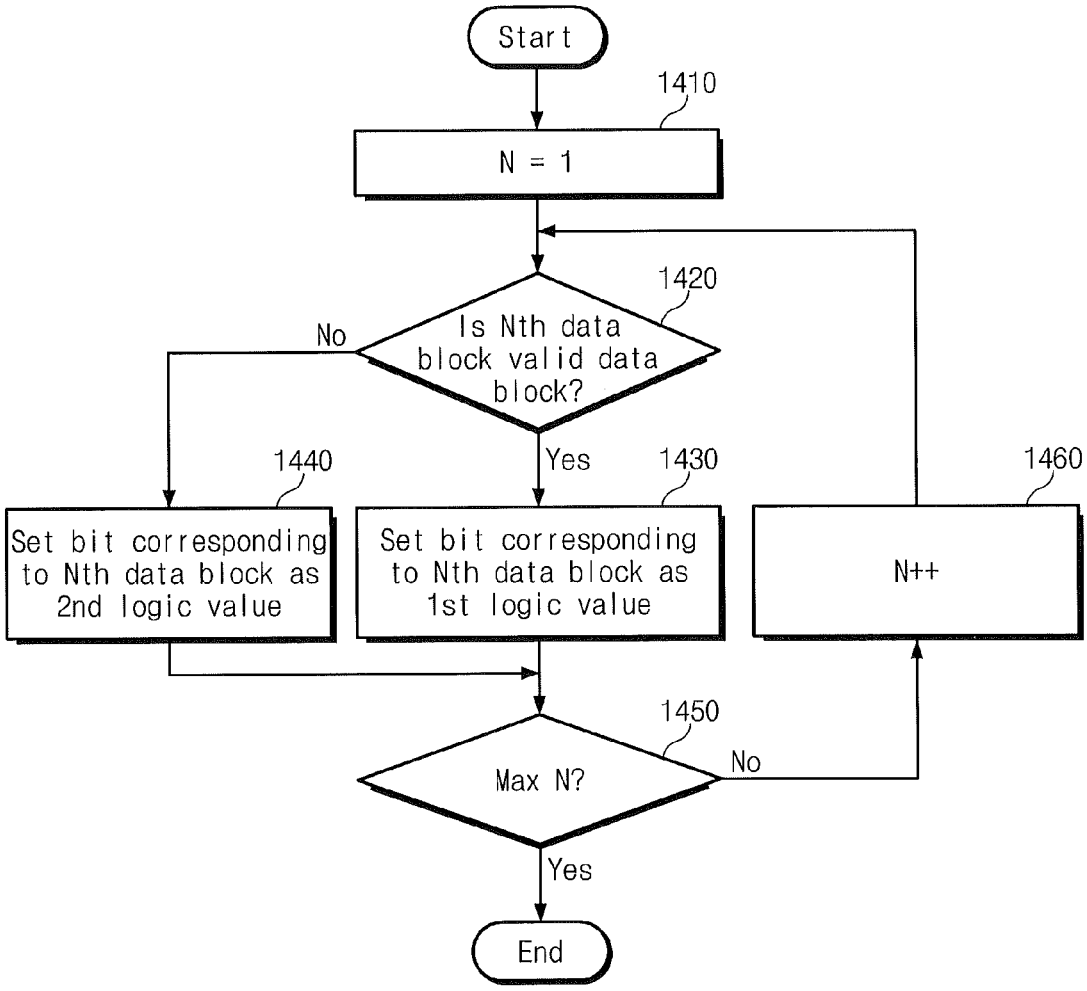
FIG. 7 is a flowchart illustrating operations according to some embodiments of storing of information of the detected invalid data ID in operations described in block 230 of FIG. 4.

FIG. 7 is a flowchart illustrating storing of information of the detected invalid data ID in operation 1230 of FIG. 4. FIG. 8 is a view illustrating a state of the display buffer 155 according to the operation of FIG. 7. Referring to FIGS. 1, 7, and 8, in operation 1410, a value of the block variable N is set as 1.

In operation 1420, it is determined whether an Nth data block is a valid data block or not. If the Nth data block is a valid data block, it proceeds to operation 1430. If the Nth data block is an invalid data block, it proceeds to operation 1440.

For example, a storage capacity of the display buffer 155 may correspond to the number of divided data blocks of the second layer data L2. Bits of the display buffer 155 correspond to the divided data blocks of the second layer data L2. For example, for convenience of description, bits of the display buffer 155 are illustrated in FIG. 8 in the same grid as the divided blocks of the second layer data L2 shown in FIG. 6. However, a configuration of the display buffer 155 is not limited to FIG. 8.

If the Nth data block is a valid data block, in operation 1430, the display controller 153 sets a bit of the display buffer 155 corresponding to the Nth data block as a first logic value. If the Nth data block is an invalid data block, in operation 1440, the display controller 153 sets a bit of the display buffer 155 corresponding to the Nth data block as a second logic value.

In operation 1450, it is determined whether a value of the block variable N is the maximum value or not. If the value of the block variable N is the maximum value, an operation of storing the detected invalid data ID is terminated. If the value of the block variable N is not the maximum value, the block variable N is added by a predetermined value in operation 1460. Then, operation 1420 may be performed again.

As shown in FIG. 8, bits corresponding to the data blocks determined as the valid data blocks are set as a first logic value 1 and bits corresponding to the data blocks determined as the invalid data blocks are set as a second logic value 0. The first logic value is not limited to 1 and also the second logic value is not limited to 0. For example, some embodiments provide that the first logic value may be 0 and the second logic value may be 1.

As mentioned above, the display unit 150 divides the second layer data L2 into data blocks and determines validness by a data block unit. The determination result is stored in the display buffer 155. Accordingly, the second display unit 150 determines valid data and invalid data among the second layer data L2 based on the information stored in the display buffer 155.

For example, the operations described with reference to FIGS. 4 through 8 may constitute an initial operation of the display unit 150. That is, if there is no information about valid data or invalid data of the second layer data L2 in the display buffer 155, the operations described with reference to FIGS. 4 through 8 are performed, such that information about the valid data or invalid data of the second layer data L2 is stored in the display buffer 155.

In the above embodiments, the operation (i.e., operation 1220 of FIG. 4 and FIG. 5) of detecting invalid data or an invalid data block and the operation (i.e., operation 1240 of FIG. 4 and FIG. 7) of storing information of the detected invalid data (or in invalid data block) may be separately performed. However, the operation of detecting invalid data or an invalid data block and the operation of storing information of invalid data or an invalid data may constitute one operation. That is, the operation described with reference to FIG. 5 and the operation described with reference to FIG. 7 may be simultaneously performed.

For example, validness of the Nth data block is detected and the detection result is stored in the display buffer 155. Then, according to whether the block variable N is the maximum value or not, the block variable N is added by a predetermined value or the operation is terminated.

Figure 9:
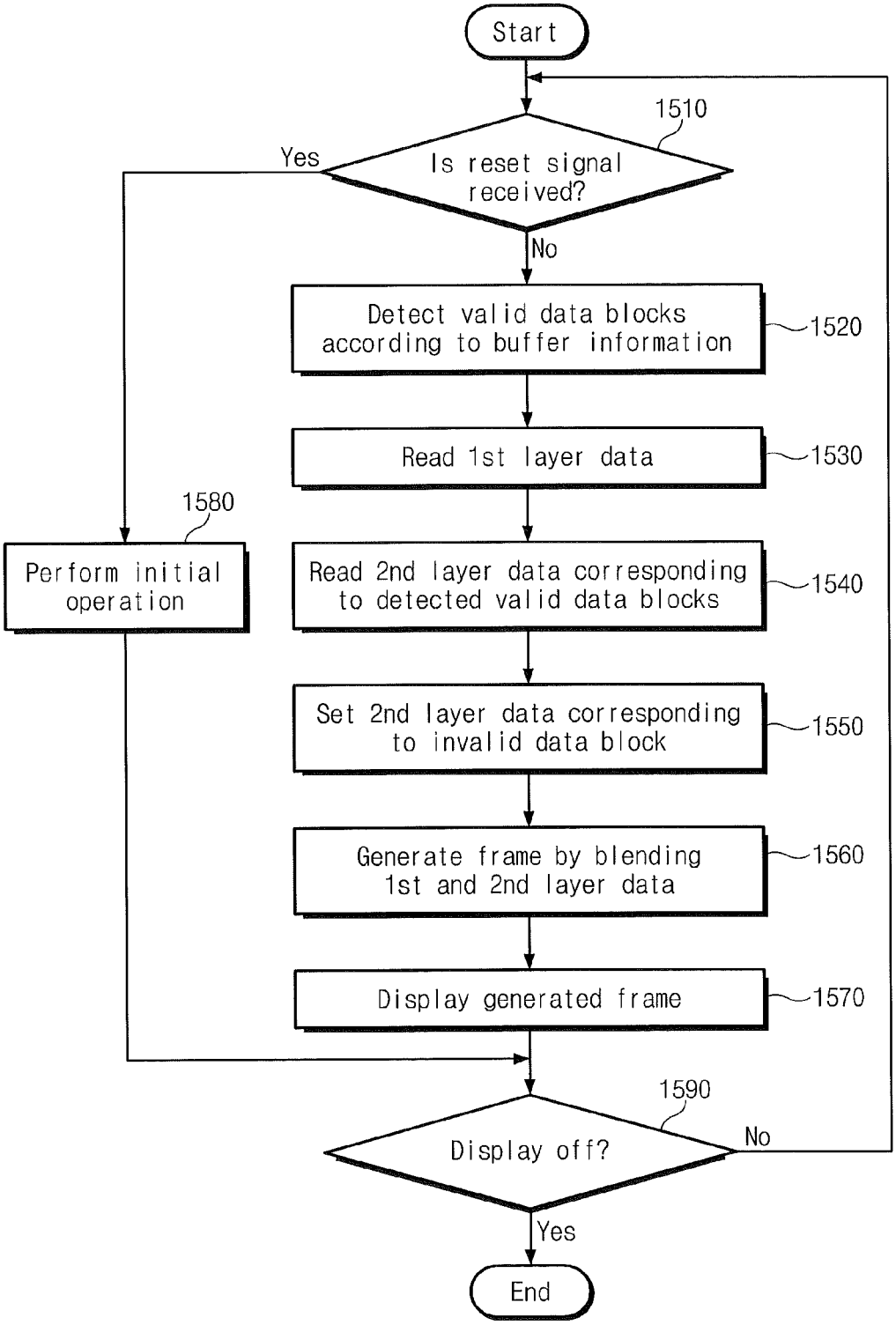
FIG. 9 is a flowchart illustrating an operating method of reading partial data of a second layer data L2 and displaying the read partial data through the display unit of FIG. 1.

FIG. 9 is a flowchart illustrating an operating method of reading partial data of a second layer data L2 and displaying the read partial data through the display unit 150 of FIG. 1. Referring to FIGS. 1, 2, and 9, in operation 1510, it is determined whether a reset signal is received or not. If the reset signal is not received, it proceeds to operation 1520. If the reset signal is received, it proceeds to operation 1580.

In operation 1520, according to information of the display buffer 155, valid data blocks of the second layer data L2 are detected. For example, bits having a first logic value 1 are detected in the display buffer 155 shown in FIG. 8. Then, valid data blocks among data blocks of the second layer data L2 corresponding to the detected bits are detected.

In operation 1530, the display unit 150 reads a first layer data L1. In operation 1540, the display unit 150 reads a second layer corresponding to the detected valid data blocks. That is, the display unit 150 reads partial data corresponding to the detected valid data blocks from the second layer data L2.

In operation 1550, the display unit 150 sets the second layer data L2 corresponding to an invalid data block. For example, the display unit 150 sets the second layer data L2 corresponding to an invalid data block as a specific chroma-key value or a specific alpha value.

That is, in operations 1540 and 1550, partial data corresponding to a valid data block in the second layer data L2 are read from the storage unit 130 and partial data corresponding to an invalid data block are set as a specific value in the storage unit 150. Accordingly, once operations 1540 and 1550 are performed, entire data of the second layer data L2 are provided.

In operation 1560, the display unit 150 blends the first layer data L1 and the second layer data L2 to generate a frame F.

The display unit 150 blends the first layer data L1 read in operation 1530 and the second layer data L2 provided from operations 1540 and 1550 to generate the frame F. In operation 1570, the display unit 150 displays the generated frame F.

In operation 1590, the display unit 150 determines whether the displaying of the frame F is finished or not. For example, the display unit 150 determines whether a display off signal is received from the processing unit 120 or not. If the display off signal is received from the processing unit 120, the display unit 150 terminates the display operation. For example, when power is cut off, the display unit 150 terminates the display operation. If the displaying of the frame F is not finished, it proceeds to operation 1510 again. In operation 1510, once the reset signal is received from the processing unit 120, the display unit 150 performs the initial operation described with reference to FIGS. 4 through 9 in operation 1580. The display unit 150 resets the display buffer 155 and performs the initial operation described with reference to FIGS. 4 through 8.

As mentioned above, during the initial operation, the display unit 150 detects information about valid data or invalid data of the second layer data L2. After the initial operation, the display unit 150 reads partial data of the second layer data L2 based on the information stored in the display buffer 155.

When the second layer data L2 are updated (for example, when a menu or a pointer is manipulated or a date or a time is changed), the processing unit 120 generates a reset signal. The processing unit 150 performs the initial operation again in response to the reset signal. That is, when the second layer data L2 are updated, the display unit 150 reads the entire second layer data L2 and displays them, and detects and stores information about a valid data block or an invalid data block of the read second layer data L2. Then, the display unit 150 performs a partial reading operation of the second layer data L2 according to the information stored in the display buffer 150.

According to the inventive concept, an amount of the second layer data L2 that the display unit 150 reads from the storage unit 130 is reduced. Since a bandwidth of the storage unit 130 that the display unit 150 consumes is reduced, bandwidth efficiency of the storage unit 130 can be improved. Additionally, power consumption by the storage unit 130 and the display unit 150 can be reduced.

In the above embodiments, it is described that the display unit 150 reads partial data of the second layer data L2. However, the display unit 150 may be configured to read partial data of the first layer data L1.

Moreover, the display unit 150 may be configured to read partial data of the first layer data L1 and partial data of the second layer data L2. At this point, both information about valid data or invalid data of the first layer data L1 and information about valid data or invalid data of the second layer data L2 are stored in the display buffer 155.

In the above embodiments, it is described that when the first layer data L1 and the second layer data L2 are blended, the second layer data L2 are adjusted based on a chroma-key value or an alpha value. However, some embodiments provide that the first layer data L1 may be adjusted also based on a chroma-key value or an alpha value.

In the above embodiments, it is described that the storage unit 130 is a function block separated from the display unit 150. However, the storage unit 130 may be provided as a component of the display unit 150.

In the above embodiments, it is described that the interface unit 140 is a function block separated from the display unit 150. However, the interface unit 140 and the display unit 150 may constitute one function block. For example, the interface unit 140 may be a touch interface built in the display unit 150.

In the above embodiments, it is described that the processing unit 120 stores layer data in the storage unit 130. However, the image display device 100 may include a separate graphic processing unit (not shown). At this point, the processing unit 120 and the graphic processing unit may be configured to store layer data in the storage unit 130. For example, the graphic processing unit may be provided as a component of the display unit 150.

Figure 10:
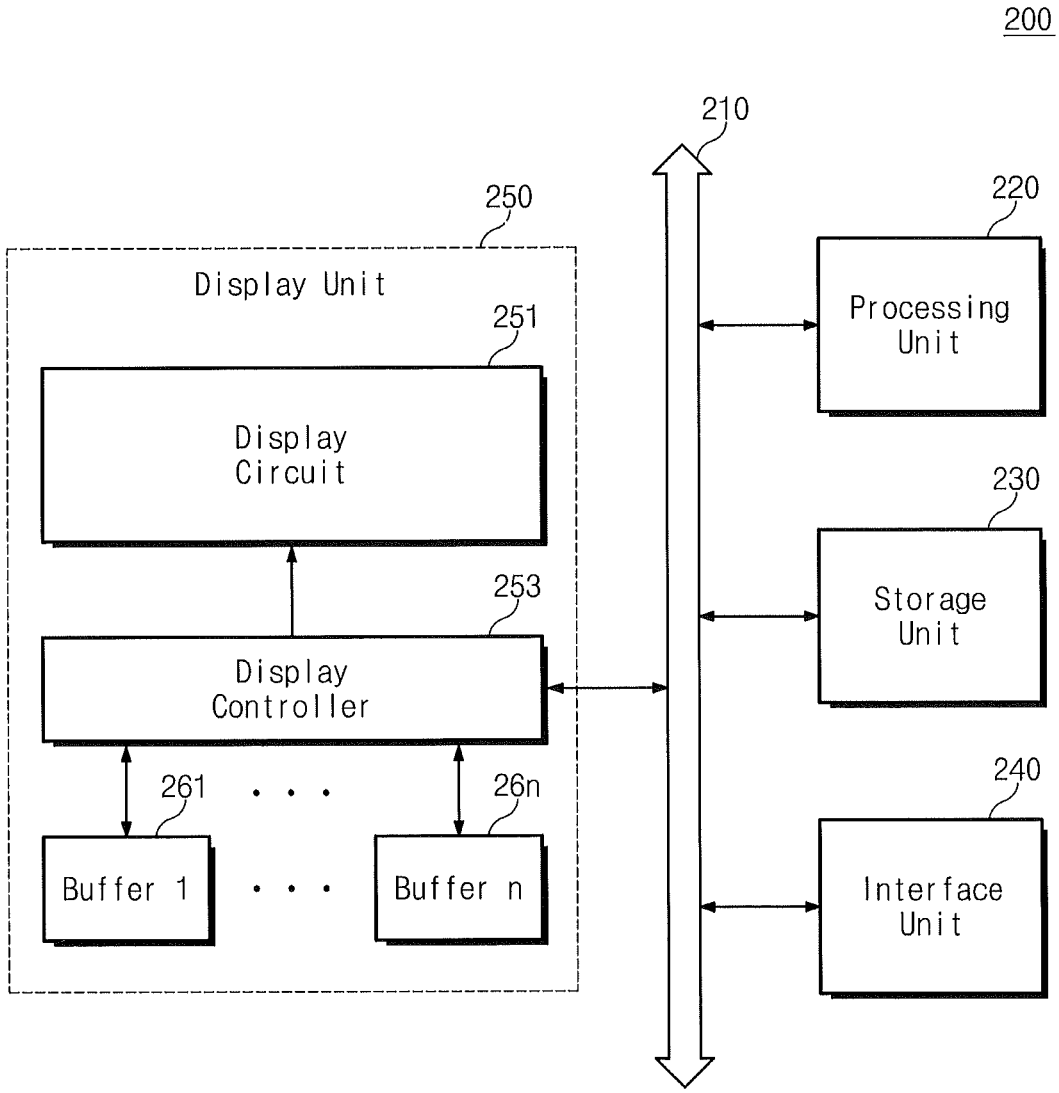
FIG. 10 is a block diagram illustrating an image display device 200 according to some embodiments of the inventive concept.

FIG. 10 is a block diagram illustrating an image display device 200 according to some embodiments of the inventive concept. Referring to FIG. 10, the image display device 200 includes a system bus 210, a processing unit 220, a storage unit 230, an interface unit 240, and a display unit 250.

The system bus 210, the storage unit 230, and the interface 240 are the same as those 110, 130, and 140 described with reference to FIG. 1. Accordingly, their detailed description will be omitted.

The processing unit 220 is configured to store data of a plurality of layers in the storage unit 230.

The display unit 250 reads the data of the plurality of layers stored in the storage unit 230. The display unit 250 is configured to store information about valid data or invalid data in data of at least two layers among the read data of the plurality of layers in first to n buffers 261 to **26*n***.

For example, the first to n buffers 261 to **26*n*** are configured to store information about valid data or invalid data of each one layer data.

For example, at least two of the first to n buffers 261 to **26*n*** may be configured to store information about valid data or invalid data among one layer data.

The display controller 253 partially reads data of at least two layers from the data of the plurality of layers stored in the storage unit 230, based on the information about valid data or invalid data stored in the first to n buffers 261 to **26*n*. The display controller 253 blends the read layer data and displays them through the display circuit 251**.

According to the inventive concept, an image is displayed based on valid data among layer data including invalid data and valid data. Accordingly, an image display device and a method of displaying an image with improved operating efficiency and reduced power consumption are provided.

The above-disclosed subject matter is to be considered illustrative and not restrictive, and the appended claims are intended to cover all such modifications, enhancements, and other embodiments, which fall within the true spirit and scope of the inventive concept. Thus, to the maximum extent allowed by law, the scope of the inventive concept is to be determined by the broadest permissible interpretation of the following claims and their equivalents, and shall not be restricted or limited by the foregoing detailed description.

What is claimed is:

1. A method of displaying image data, the method comprising:

reading first layer data;

reading partial data of second layer data;

blending the first layer data and the partial data of the second layer data to generate blended data; and displaying the blended data, wherein the second layer data comprises valid data and invalid data, wherein reading the partial data of the second layer data comprises reading the valid data of the second layer data not the invalid data of the second layer data, and wherein the second layer data is divided into a plurality of data blocks, each block being validated or invalidated independently.

2. The method of claim 1, further comprising:

updating the second layer data; and when the second layer data are updated, reading the first layer data, the updated second layer data and the partial data of the third layer, blending the first layer data, the read second layer data and the partial data of the third layer to generate the blended data.

3. The method of claim 2, further comprising, after updating the second layer data, detecting valid data in the updated second layer data.

4. The method of claim 3, further comprising, after detecting the valid data in the updated second layer data, reading the first layer data, reading valid data in the updated second layer data, blending the read first layer data, the read valid data of the second layer data, and displaying the blended data.

5. The method of claim 3, wherein detecting the valid data comprises:

detecting data of at least one data block of the plurality of data blocks that includes a valid pixel value as valid data.

6. The method of claim 5, wherein an invalid pixel value corresponds to a specific chroma-key value.

7. The method of claim 5, wherein an invalid pixel value corresponds to a specific alpha value.

8. The method of claim 1, wherein reading the first layer data comprises reading partial data of the first layer data.

9. The method of claim 1, further comprising:

reading partial data of third layer data; and blending the first layer data, the partial data of the second layer data and the partial data of third layer data to generate the blended data.

10. A method of displaying an image, the method comprising:

reading first layer data and second layer data from an image display device data storage unit;

detecting invalid data in the second layer data;

storing, in a display buffer, information corresponding to the invalid data in the second layer data;

adjusting the second layer data responsive to the invalid data of the second layer data not the first layer data;

generating a display frame by blending the first layer data and adjusted second layer data; and displaying the display frame generated by blending the first layer data and the adjusted second layer data.

11. The method of claim 10, wherein the second layer data comprises valid data and the invalid data; and wherein reading the data of the second layer data comprises reading the valid data of the second layer data.

12. An image display device comprising:

a processing unit that is configured to generate first layer data and second layer data and to store the generated first layer data and the generated second layer data in a storage unit; and a display unit that is configured to read the first layer data and partial data of the second layer data from the storage unit, to blend the first layer data and the partial data of the second layer data to generate blended data, and to display the blended data, wherein the display unit comprises a display buffer that is configured to store information about valid data and invalid data in the second layer data and to read the valid data in the second layer data from the storage unit based on the information stored in the display buffer without reading the invalid data in the second layer data, wherein the second layer data is divided into a plurality of data blocks; the plurality of data blocks correspond to a plurality of bits of the display buffer, respectively; and according to whether a specific data block among the plurality of data blocks includes a valid pixel value or not, setting a corresponding bit of the plurality of bits of the display buffer as a first logic value or a second logic value, and wherein, when the second layer data are updated, the processing unit is configured to activate a reset signal and the display unit is configured to reset the plurality of bits of the display buffer as the first logic value in response to the activated reset signal.

13. The image display device of claim 12, wherein the display unit is configured to read data of at least one data block of the plurality of data blocks of the second layer data corresponding to bits having the first logic value among the plurality of bits of the display buffer.

14. An image display device comprising:

a processing unit that is configured to generate first layer data and second layer data and to store the generated first layer data and the generated second layer data in a storage unit; and a display unit that is configured to read the first layer data and partial data of the second layer data from the storage unit, to blend the first layer data and the partial data of the second layer data to generate blended data, and to display the blended data, wherein the processing unit is further configured to store third layer data in the storage unit, wherein the display unit is further configured to read the first layer data, the partial data of the second layer data, and partial data of the third layer data from the storage unit, to blend the first layer data, the partial data of the second layer data, and the partial data of the third layer data, and to display the blended data, wherein the display unit comprises:

a first display buffer that is configured to store information about valid data and invalid data in the second layer data; and a second display buffer that is configured to store information about valid data and invalid data in the third layer data, wherein the display unit is configured to read valid data in the second layer data from the storage unit based on the information stored in the first display buffer and to read valid data in the third layer data from the storage unit based on the information stored in the second display buffer.

15. The image display device of claim 14, wherein the first and second buffers respectively correspond to first and second storage regions in one buffer.

* * * * *